United States Patent [19]

Takai et al.

[11] Patent Number: 4,913,889

[45] Date of Patent: Apr. 3, 1990

[54] HIGH STRENGTH HIGH MODULUS CARBON FIBERS

[75] Inventors: Yasuyuki Takai; Minoru Takabatake; Hideyuki Nakajima; Katsumi Takano, all of Hasaki; Masami Watanabe, Suginami, all of Japan

[73] Assignee: Kashima Oil Company, Tokyo, Japan

[21] Appl. No.: 119,602

[22] Filed: Nov. 12, 1987

Related U.S. Application Data

[63] Continuation-in-part of Ser. No. 774,790, Sep. 11, 1985, abandoned, which is a continuation-in-part of Ser. No. 562,132, Dec. 16, 1983, and Ser. No. 738,315, May 28, 1985, abandoned, which is a continuation-in-part of Ser. No. 681,334, Dec. 13, 1984, abandoned, which is a continuation-in-part of Ser. No. 638,085, Aug. 6, 1984, abandoned.

[30] Foreign Application Priority Data

| | | | |
|---|---|---|---|
| Mar. 9, 1983 | [JP] | Japan | 58-37310 |
| Nov. 10, 1983 | [JP] | Japan | 58-209856 |
| Sep. 5, 1984 | [JP] | Japan | 59-184491 |

[51] Int. Cl.[4] ..... D01F 9/12

[52] U.S. Cl. ..... 423/447.1; 264/29.2; 423/447.2; 423/447.4; 423/447.6

[58] Field of Search ..... 423/447.1, 447.2, 447.4, 423/447.6; 264/29.2, 211.14

[56] References Cited

U.S. PATENT DOCUMENTS

| | | | |
|---|---|---|---|
| Re. 27,704 | 10/1973 | Otani et al. | 264/29 |
| 3,919,376 | 11/1975 | Schulz | 264/29 |
| 3,919,387 | 11/1975 | Singer | 423/447 |
| 3,928,170 | 12/1975 | Takahashi et al. | 208/40 |
| 3,974,264 | 8/1976 | McHenry | 423/447.4 |
| 3,976,729 | 8/1976 | Lewis et al. | 264/29.7 |
| 3,991,170 | 11/1976 | Singer | 423/449 |
| 3,995,014 | 11/1976 | Lewis | 423/447.4 |
| 4,001,357 | 1/1977 | Walz et al. | 264/211.14 |
| 4,005,183 | 1/1977 | Singer | 423/447.4 |
| 4,014,725 | 3/1977 | Schulz | 423/447.1 |
| 4,016,247 | 4/1977 | Otani et al. | 423/447.4 |

(List continued on next page.)

FOREIGN PATENT DOCUMENTS

| | | | |
|---|---|---|---|
| 0027739 | 4/1981 | European Pat. Off. | 208/44 |
| 0044714 | 1/1982 | European Pat. Off. | 208/44 |
| 54-58412 | 6/1979 | Japan | 264/29.2 |
| 57-47385 | 3/1982 | Japan | 423/447.1 |
| 58-101191 | 6/1983 | Japan | 423/447.2 |
| 59-168125 | 9/1984 | Japan | 264/29.2 |
| 1220482 | 1/1971 | United Kingdom | 423/447.2 |
| 1386679 | 3/1975 | United Kingdom | 264/29.2 |
| 1416614 | 12/1975 | United Kingdom | 423/447.4 |
| 2095222 | 3/1981 | United Kingdom | 264/29.2 |
| 2099845 | 12/1982 | United Kingdom | 208/22 |

OTHER PUBLICATIONS

Ehnastiak et al., High Strength Carbon Fibers from Mesophase Pitch, Carbon, vol. 17, 1979, No. 1, pp. 49 to 53.

Bright et al., The Electronic and Structural Characteristics of Carbon Fibers . . . , Carbon, vol. 17, No. 1, 1979, pp. 59 to 69.

Singer, The Mesophase and High Modulus Carbon Fibers from Pitch, Carbon, vol. 16, No. 6, 1978, pp. 409–415.

Otani et al., High Modulus Carbon Fibers from Pitch Materials, Bull. Chem. Soc., Japan, vol. 45, 3710–3714 (1972).

(List continued on next page.)

*Primary Examiner*—John Doll
*Assistant Examiner*—Robert M. Kunemund
*Attorney, Agent, or Firm*—Armstrong, Nikaido, Marmelstein & Kubovcik

[57] ABSTRACT

High strength, high modulus carbon fibers derived from high mesophase content pitch, having a plurality of sheets formed of planes of hexagonal carbon networks oriented, in the direction of the fiber axis and having a cross-sectional arrangement which does not carbonize to a graphitic structure are characterized by electron and X-ray diffraction pattern wherein the (10) band is not resolved into (100) and (101) lines, by an interlayer spacing greater than 3.38 angstrom and by negative magnetic resistivity when composed to graphitized fibers.

7 Claims, 8 Drawing Sheets

U.S. PATENT DOCUMENTS

| | | | |
|---|---|---|---|
| 4,017,327 | 4/1977 | Lewis et al. | 423/447.4 |
| 4,026,788 | 5/1977 | McHenry | 208/39 |
| 4,032,430 | 6/1977 | Lewis | 208/39 |
| 4,032,607 | 6/1977 | Schulz | 423/477.4 |
| 4,056,597 | 11/1977 | Cooper | 264/169 |
| 4,115,527 | 9/1978 | Otani et al. | 423/447.4 |
| 4,138,525 | 2/1979 | Schulz | 423/447.6 |
| 4,184,942 | 1/1980 | Angier et al. | 423/447.1 |
| 4,208,267 | 6/1980 | Diefendorf et al. | 208/22 |
| 4,209,500 | 6/1980 | Chuastiak | 264/29.2 |
| 4,271,006 | 6/1981 | Dickakian | 208/40 |
| 4,275,051 | 6/1981 | Barr | 423/447.2 |
| 4,276,278 | 6/1981 | Barr et al. | 423/447.4 |
| 4,277,324 | 7/1981 | Greenwood | 208/45 |
| 4,277,325 | 7/1981 | Greenwood | 208/45 |
| 4,283,269 | 8/1981 | Greenwood | 208/45 |
| 4,303,631 | 12/1981 | Lewis et al. | 423/447.1 |
| 4,317,809 | 3/1982 | Lewis et al. | 423/447.1 |
| 4,331,620 | 5/1982 | Diefendorf et al. | 264/29.2 |
| 4,341,621 | 7/1982 | Fitzgerald | 208/45 |
| 4,351,816 | 9/1982 | Schulz | 423/447.4 |
| 4,363,715 | 12/1982 | Dickakian | 208/40 |
| 4,376,747 | 3/1983 | Nazem | 264/29.2 |
| 4,402,928 | 9/1983 | Lewis et al. | 423/447.1 |
| 4,414,095 | 11/1983 | Dickakian | 423/447.2 |
| 4,414,096 | 11/1983 | Dickakian | 208/44 |
| 4,424,145 | 1/1984 | Sara | 423/447.1 |
| 4,427,530 | 1/1984 | Dickakian | 423/447.2 |
| 4,427,531 | 1/1984 | Dickakian | 208/40 |
| 4,431,512 | 2/1984 | Dickakian | 423/447.4 |
| 4,431,513 | 2/1984 | Lewis | 208/44 |
| 4,440,624 | 4/1984 | Uemura et al. | 423/447.2 |
| 4,443,324 | 4/1984 | Diefendorf et al. | 423/447.2 |
| 4,448,670 | 5/1984 | Dickakian | 423/447.4 |
| 4,457,828 | 7/1984 | Lewis | 208/22 |
| 4,464,248 | 8/1984 | Dickakian | 208/44 |
| 4,465,585 | 8/1984 | Lewis | 208/22 |
| 4,465,586 | 8/1984 | Diefendorf et al. | 423/447.4 |
| 4,480,977 | 11/1984 | Nazem | 425/192 S |
| 4,504,454 | 3/1985 | Riggs | 423/447.1 |
| 4,511,625 | 4/1985 | Nazem et al. | 423/447.2 |
| 4,512,874 | 4/1985 | Watanabe | 208/44 |
| 4,529,498 | 7/1985 | Watanabe | 208/44 |
| 4,529,499 | 7/1985 | Watanabe | 208/44 |
| 4,576,811 | 3/1986 | Riggs et al. | 423/447.2 |
| 4,591,424 | 5/1986 | Gomi et al. | 208/40 |
| 4,686,096 | 8/1987 | Schulz et al. | 423/447.1 |

OTHER PUBLICATIONS

Franklin, The Structure of Graphitic Carbons, Acta, Cryst., (1951), No. 4, pp. 253 to 261.

Dresselhaus et al., Graphite Fibers and Filaments, Springer-Verlag, Berlin, W. Germany, 1988.

Guigon et al., Microtexture and Structure of Some High Tensile Strength, Pan-Base Carbon Fibers, Fibre Science and Tech., 20 (1984), to to 72, 177 to 198.

HIGH STRENGTH HIGH MODULUS CARBON FIBERS

CROSS REFERENCE TO RELATED APPLICATION

This application is a continuation-in-part of copending application Ser. No. 774,790, now abandoned, filed Sept. 11, 1985, which is a continuation-in-part of copending application Ser. No. 562,132, filed Dec. 16, 1983, a continuation in part of copending application Ser. No. 738,315, filed May 28, 1985, now abandoned, which is a continuation-in-part of U.S. Ser. No. 681,334, filed Dec. 13, 1984, now abandoned, which was a continuation-in-part of copending application Ser. No. 638,085, filed Aug. 6, 1984, now abandoned.

BACKGROUND OF THE INVENTION

Field of the Invention and Related Art Statement

This invention relates to high strength, high modulus carbon fiber filament yarns and to a method for producing the same. More particularly, it relates to filament yarns of high strength, high modulus carbon fibers, having a fold structure (sometimes known as wrinkled layers) in the fiber cross-section, which do not form the well-ordered three dimensional structure unique to polycrystalline graphite and to a method for producing the same as a crack-free filament from a specified pitch by using specified spinning nozzles under specified conditions.

Materials prepared by a combination of special materials are required in many industries to produce products having high strength and high Young's modulus, together with light weight Among the most promising materials to be used are resins, reinforced with high strength, high modulus carbon fibers. When the carbon fibers are combined with a resin, it is possible to produce reinforced resins capable of exhibiting characteristic features unparalleled in the past. In spite of the high strength and high modulus of the carbon fibers for the above-mentioned reinforced resins, the applications of these fibers have not greatly expanded due to the high production cost.

The high strength, high modulus carbon fibers which are commercially available include polyacrylonitrile-based fibers (hereinafter PAN fibers) produced by special production processes and a special spinning process but these fibers are not only expensive as a precursor of carbon fibers but also, the production yield thereof from the precursor is as low as less than 45%. These facts complicate the treatment steps and enlarge production facilities for producing superior carbon fibers, resulting in very high production cost of the ultimate products using carbon fibers. The production cost of high strength, high modulus carbon fibers of the ultimate product is further increased by the treatment and disposal cost for the hydrocyanic acid by-product generated at the time of carbonization treatment.

Several alternative materials are known from which carbon fibers can be produced. For example, carbon fibers have been obtained by the pyrolysis of cotton, rayon, PVC and PVA fibers [Otani, *Carbon* 3, 31, (1965)]. Vapor grown fibers have been reported.

One material which is used as an alternative to PAN is mesophase pitch. A term "mesophase" herein referred to is one of the components constituting the pitch and it means an optically anisotropic part of a coal or petroleum base pitch which shines brilliantly when the section of a lump of pitch solidified at a temperature close to room temperature is polished and observed through the crossed nicholas of a reflection type polarizing microscopy. A pitch mostly composed of mesophase is called mesophase pitch. The content of mesophase in, a mesophase pitch is calculated from the percentage of the area of optically anisotropic part obtained by observation under a reflection type polarizing microscope.

DESCRIPTION OF THE ART

Recently, there has been a demand for high strength and high modulus light-weight materials in various fields, e.g., in aircraft, motor vehicle and other industries, and in this connection, a demand for carbon fibers provided with the abovementioned properties is rapidly increasing. It is well known that the starting material for high strength, high modulus carbon fibers available now in the market are mostly polyacrylonitrile fibers. However, these polyacrylonitrile fibers are not only expensive but also give only a low yield of carbon fibers, e.g. about 45%. This fact also increases the production cost of the ultimate products of carbon fibers.

As one method for producing high strength, high modulus carbon fibers at a low cost, there are descriptions in the official gazette of Japanese Patent Publication No. 1810 (1979) issued to Union Carbide Corporation and it is a well known fact that mesophase-containing pitches are excellent raw materials for filament yarns of high strength, high modulus carbon fibers. The content and the physical properties of mesophase itself naturally give large influence upon the physical properties of carbon fibers. The higher the mesophase content and the better the quality of mesophase, the greater the improvement of the physical properties of carbon fibers. Further, pitch of low mesophase content is not adequate as a raw material for high strength, high modulus carbon fibers because both the strength and modulus of the carbon fibers obtained therefrom are low.

One method for producing height strength, high modulus carbon fibers at a low cost, is described in U.S. Pat. No. 4,209,500 to Chwastiak and it is reported that mesophase-containing pitches are extremely superior raw material for filament yarns of high strength, high Young's modulus carbon fibers. When pitches are used as raw materials for carbon fibers, the content of mesophase and the physical properties of mesophase itself naturally has a large influence upon the physical properties of carbon fibers. As a general rule, the higher the mesophase content and the better the quality of the mesophase, the greater the improvement in the physical properties of carbon fibers. Pitches of low mesophase content are not adequate as a raw material for high strength, high modulus carbon fibers because the resultant fibers have a low strength and low Young's modulus. As for the structure of the cross-section of pitch-derived carbon fibers, it has been known that roughly random shape (orderless), radial shape (radial), concentric circle shape (onion skin), and mixed structures of carbon arrangement exist [The 12th Biennial Conference on Carbon, July 329 (1975) ; Pittsburgh, and Ceramics 11 (1976) No. 7, Nos 612–621]. These structures depend greatly upon the physical properties of raw material pitch and the shape of the spinnerettes used. When melt-spinning is carried out by using a spinning nozzle in which the narrow channel for the passage for molten pitch is a straight tube having a circular cross-section, as is commonly used, filaments of carbon fibers thus obtained show a structure in which the carbonaceous material is radially oriented. This is because the hiqher the mesophase content of a raw material pitch, the higher the orientation degree of the carbonaceous material of the filament produced by melt-spinning, and after thermosetting and carbonization, the obtained carbon fibers have noticeable radial structure. Filaments of carbon fibers having radial structure very often form big cracks extending from the circumference of cross-section toward the center of a filament. The resultant carbon fibers are structurally flawed and have little value as articles of commerce.

Carbon fibers produced from high mesophase content pitch of petroleum origin, as a raw material, through a melt-spinning process by using nozzles having a circular cross-section in which the outlet part thereof is not broadened, followed by the steps of thermosetting and carbonization at a high temperature, e.g. 2000° C.~3000° C., in order to give high strength and high modulus of elasticity, show mostly a radial arrangement of carbon fibers and have frequent cracks in their cross-sections. These cracks appear due to the three dimensional arrangements of carbon atoms which is a characteristic feature of polycrystalline graphite.

The structure of fiber seen in cross-section becomes radial and the shrinkage between the surfaces of carbon layers occurs in one fixed direction. In such a condition, cracks are liable to occur and, if they occur, the commercial value of the products is lost. The characteristic three-dimensional arrangement of polycrystalline graphite is indicated by the X-ray diffraction lines of the fibers. Specifically, it is shown by the presence of (112) cross-lattice line and separation of a broad (10) diffraction band into discrete (100) and (101) lines when the carbon fibers have been heated at a temperature higher than 2500° C., preferably higher than 2800° C., as described in the literature such as Japanese Patent Publication No. 3567 of 1984 and U.S. Pat. No. 4,005,183. Also, the inter-layer spacing of band (002) (i.e. $d_{002}$) is less than 3.37 A usually in the range of 3.36 to 3.37 A, and the electric resistance is smaller than $250\times10^{-6}$ ohm-cm, and usually in the range of $150\times10^{-6}$ to $200\times10^{-6}$ ohm-cm at room temperature.

Accordingly, it is an object of the present invention to provide a method for producing high strength, high modulus carbon fibers having none of the drawbacks of conventional carbon fibers prepared according to conventional technique as above-mentioned (such as high cost and crack forming) but having sufficient value as articles of commerce.

BRIEF SUMMARY OF THE INVENTION

According to the present invention, there is provided carbon fibers derived from mesophase pitch, which, in the direction of the fiber axis, take a structure wherein crystal structure is essentially that of a highly organized pitch, but in their fiber cross-section, take a structure wherein the basic structural element consists of plurality of folded layers of a hexagonal carbon network plane. The carbon fibers having the abovementioned structure can be obtained from a raw material in which mesophase content of pitch has been increased from greater than 70% to as high as 100% as a highest grade of quality, by using a spinning nozzle for spinning the molten dope which has an outlet part cross-sectional area greater than the; narrowest cross-sectional area of extrusion hole, as shown for example, in FIGS. 1 and 2 hereinafter illustrated (but not strictly limited thereto), and at specified spinning temperature, followed by thermosetting and carbonizing processing.

In the process of the present invention, melt spinning is carried out at a temperature of 250° to 350° C.

As for a raw material of mesophase pitch issued in the process of the present invention, petroleum-origin heavy oil, such as topped crude (reduced C. or long residue), vacuum residue (short residue), the residue of thermal catalytic cracking of vacuum gas oil, tar or pitch produced as a by-product of heat treatment of these residues and a coal-origin heavy oil such as coal tar, coal tar pitch and a coal liquefied product can be mentioned. Mesophase pitch can be produced by subjecting these raw materials to heat treatment under non-oxidative condition, such as in an inert gas atmosphere to form mesophase pitch, causing the resulting mesophase pitch to grow by aging, and separating the part mostly consisting of mesophase.

The inventors of the present application have found that filaments of carbon fibers having superior qualities can be produced at an inexpensive price according to the process of the present invention if the content of mesophase in mesophase pitch is 70% or greater, preferably greater than 90% most preferably a pitch which is substantially 100% mesophase. A mesophase pitch containing lower than 70% mesophase, when subjected to spinning according to an usual manner and then to thermosetting and carbonization, provides carbon fiber filaments which do not form radial structure in cross-section in most of; the cases, due to this low degree of carbon orientation. Even though such a structure may contain no crack, both tensile strength and Young's modulus of the resulting filaments are low, and the carbon fibers have little value as articles of commerce.

When mesophase pitch is used as a raw material of filament yarn of carbon fibers, the higher the mesophase content, the better the quality of the carbon fibers.

When mesophase pitch containing 70% or more, preferably 90% or more mesophase is melt-spun while causing velocity change in the flow of mesophase pitch inside the nozzles, using spinning nozzles having a cross-sectional area at their nozzle outlet part greater than that of the narrowest part of the path for spinning dope inside the nozzles, preferably in a ratio of 2 or greater, filament yarns of carbon fibers free of cracks can be obtained.

The mesophase pitch derived high strength, high modulus carbon fibers of this invention comprise a plurality of carbon layer sheets consisting, as a basic structural element, of a plane of carbon hexagonal network in fiber cross-section. The above-mentioned sheets form a wrinkled carbon layer structure with a radius of curvature of fold in the range of 15~200 A, preferably 20–60 A;

The above-mentioned sheets are further characterized in that the (10) band is not resolved into two different (100) and (101) lines in electron are diffraction pattern and X-ray diffraction pattern, even after being heated and carbonized at a temperature of 2000° C. to 3000° C., typical graphitizing conditions. In addition, the inter-layer spacing ($d_{002}$) of (002) band is greater than 3.38 A. The electric resistance is greater than $250\times10^{-6}$ ohm-cm at room temperature; and the magnetic resistivity, which is measured, as an index of graphitization, by applying a magnetic field in the direction at right-angles to the fiber axis, always has a negative value at temperatures between 4.2° K. (the temperature of liquid helium) and 300° K., and at a magnetic field in the range of 0 KG to 8 KG.

BRIEF DESCRIPTION

DETAILED DESCRIPTION OF THE INVENTION

The structure of the cross-section of pitch-derived carbon fibers is observable using a scanning electron microscope. There have been reported in the literature a random shape (disordered), a radial shape (radiate), and an onion shape (concentric circle shape), of carbon structural arrangement.

Figure 1:
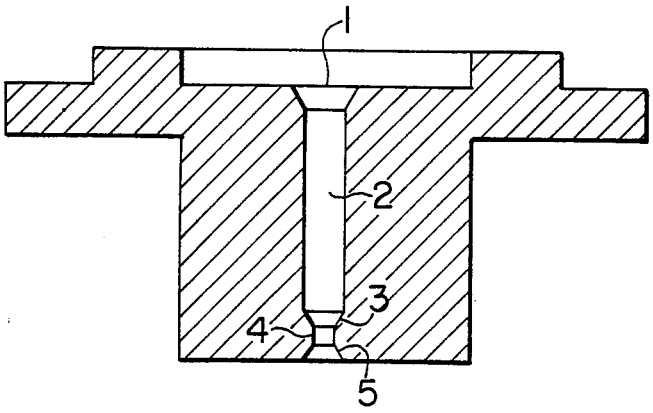
FIG. 1 is vertical cross-section passing through the center of a spinning nozzle used in the method of the present invention.
Figure 2:
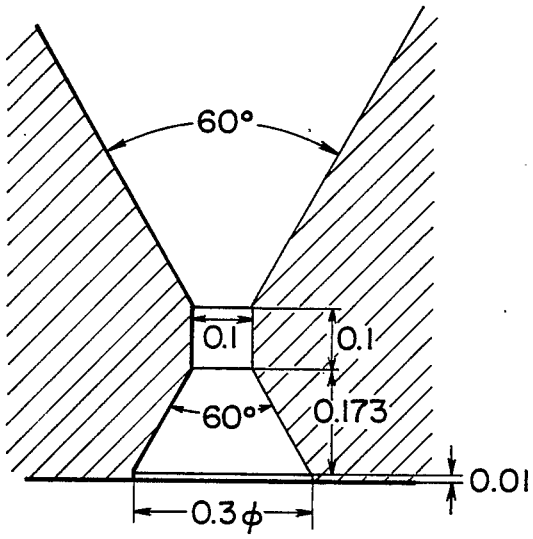
FIG. 2 is a detail of the outlet part of the same nozzle.
Figure 5:
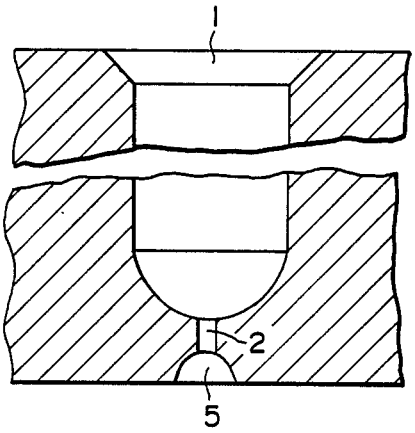
FIG. 5 is a vertical cross-section through the center of another type of nozzle according to the method of the present invention.
Figure 6:
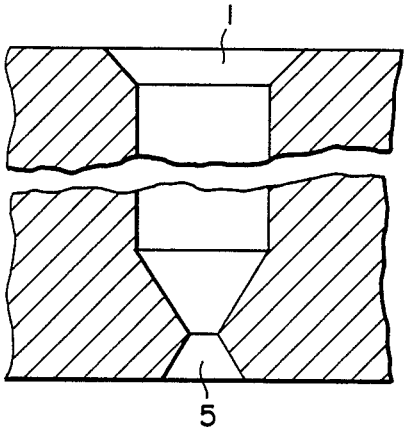
FIG. 6 is also a vertical cross-section through the center of a further type of nozzle according to a method of this invention.

The inventors of the present application have discovered, after comprehensive studies, that carbon fibers having no cracks can be obtained from high mesophase content pitch (as determined by polarized light microscopy),wherein the arrangement of carbon atoms in the cross-section of the fibers, viewed in cross-section using an SEM, has a random shape (also known as a turbulent flow shape), an onion skin shape, or a mixture of primarily radial shape with elements of random or onion shape. When carbon fibers are made of a height quality, preferably 100% mesophase pitch as a raw material, physical properties of carbon fibers, particularly strength, tend to increase. As a method for making the above-mentioned carbon fibers, it has been found that melt spinning of a high mesophase content pitch carried out at a spinning temperature of 250°-350° C. by using spinning nozzles (as shown in FIGS. 1, 5 or 6) having a greater outlet cross-section than the narrowest cross-section of nozzle inside, followed by thermosetting and carbonization, provides particularly higher strength (more than 280 $Kgf/mm^2$ in strength), higher modulus (more than $60\times10^3$ $Kgf/mm^2$ in modulus of elasticity) and that filaments of carbon fibers having no cracks at all can be produced.

It has been found that carbon fibers derived from high mesophase pitch, according to the method of the present invention, take a structure in which a carbon hexagonal network plane, characteristic of mesophase pitch derived carbon fiber, is highly oriented in the direction of the fiber axis but adopts a structure in the fiber cross sections, in which the basic element consists of folded layer of hexagonal carbon network plane (i.e. a plane formed by the condensed rings of 6 member carbon ring), with a radius of curvature of the fold falling in the range of 15 A to 200 A.

The characteristic three dimensional arrangement of polycrystalline graphite (i.e. graphite structure is identified by the X-ray diffraction patterns of the fibers. In particular, it is characterized by the presence of the (112) cross-lattice line and the resolution of a broad (10) diffraction band into distinct (100) and (101) lines when the carbon fibers are heated at a temperature higher than 2500° C., preferably higher than 2800° C., as shown in the literature such as Japanese patent publication No. 3567 of 1984 and U.S. Pat. No. 4,005,183. Also, the inter-layer spacing of band (002) (i.e. $d_{002}$) is less than 3.37 A, usually in the range of 3.36 to 3.37 A, and the electric resistance is also smaller than $250\times10^{-6}$ ohm-cm, and usually in the range of $150\times10^{-6}$ to $200\times10^{-6}$ ohm at room temperature.

The carbon fibers derived from high mesophsse pitch content according to the method of the present invention are characterized by the above-mentioned structure in that, after they are heated and carbonized at a temperature of 2000° C. ~ 3000° C., preferably 2300°~2800° C., a broad (10) band is not resolved into two distinct lines (100) and (101) in either the electron ray diffraction pattern or the X-ray diffraction pattern. The radius of curvature of the wrinkled layers is in the range of 15~200 A, the inter -layer spacing band (002) [$d_{002}$] is greater than 3.38 A, the electric resistance is greater than $250\times10^{-6}$ ohm-cm at room temperature and magnetic resistivity, which is measured by applying a magnetic field at right-angles to the fiber axis, always has a negative value at a temperature between 4.2° K. (temperature of liquid helium) and 300° K. in the magnetic field of 0 KG~8 KG. In short, the carbon fibers according to the present invention do not have the characteristic structure of polycrystalline graphite, either macroscopically and microscopically, but have a turbostratic structure.

Observation by way of SEM, shows a random shape, onion shape and portions which are a mixture of radial shape with portions having random or onion shape. By using high mesophase content pitch as a raw material, it is possible to produce mesophase pitch derived carbon fibers having greatly improved physical properties, particularly in high strength (280 $Kgf/mm^2$ or more) and high modulus(modulus of elasticity of $60\times10^3$ $Kgf/mm^2$ or more) without crack flaws by the method of the present invention.

Spinning temperature is critical when spinning high mesophase content pitch. When spinning temperature is reduced to lower than 250° C., the viscosity of 100% mesophase as raw material for spinning is so increased that spinning becomes difficult. On the other hand, when spinning temperature is higher than 350° C., the viscosity of 100% mesophase as raw material for spinning is so lowered that breakage of spun filaments occurs frequently. Accordingly, the spinning temperature for high mesophase pitch as a raw material for spinning should be within the range of 250° C. to 350° C.

Examples of the shapes of spinning nozzles accommodated in the spinnerette in a spinning machine used in the method of the present invention will be described with reference to FIGS. 1, 5 and 6 but it is offered by way of illustration and not by way of limitation.

Figure 4:
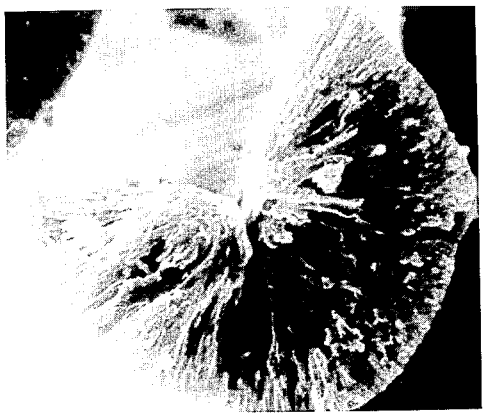
FIG. 4 is a cross-section of carbon fibers prepared according to the method of referential example of the present invention hereinafter described.

When a high mesophase content pitch is used as a raw material for carbon fibers, and melt spinning is carried out by using a spinning nozzle having circular cross-section but no enlarged outlet part, the orientation of carbon atoms in the carbon fibers takes a radial shape and creates cracks as shown in FIG. 4, wherein a crack of about 90° is formed.

However, by using a spinning nozzle having a cross-section area of the outlet part greater than that of the narrowest part of the inside of the nozzle, preferably being at least twice the narrowest part, or 15°~90° in terms of the conical angle of expansion, so as to give turbulent flow action and suppressing the development of three-dimensional arrangement of polycrystalline graphite, it is possible to make the arrangement of carbon take a random shape, an onion shape or a mixture of radial with random or onion shape and to avoid forming cracks in the carbonized fiber.

The high mesophase content pitch, preferably 100% mesophase as a raw material for producing carbon fibers is produced by subjecting a distillate fractions (an initial boiling point is from 404° C. to 409° C.) of a petroleum pitch such as a residual carbonaceous material produced as a by-product of catalytic cracking process (F.C.C.) of vacuum gas oil, to heat-treatment at a temperature of 360° C. to 420° C. by using a carrier gas which is a hydrocarbon gas of low molecular weight to produce a mesophase-containing pitch, then treating the resulting mesophase-containing pitch at an aging condition entirely different from that of mesophase formation, for a long time to melt and coalesce only mesophase, and separating (purifying) the mesophase by utilizing the difference in physical properties of mesophase and non-mesophase fractions at the aging temperature.

The inventions entitled "Method for Producing Mesophase-containing Pitch by Using a Carrier Gas", "Method for Producing Mesophase Pitch", "Improved Method for Producing Mesophase Pitch" and "Method for Producing Mesophase Continuously" by Masami Watanabe, U.S. Pat. Nos. 4,487,685, 4,529,498, 4,529,499 and 4,512,874, respectively, are incorporated by reference.

The detailed structure of the fold or wrinkle of layers of the hexagonal carbon network plane cannot be characterized by the surface observation using a scanning electron microscope (SEM). The observation is usually carried out by image observation, using the (002) diffraction line in dark field using a transmission electron microscope (TEM). The size of the fold radius can be obtained from this image. The fibers first are immersed in a resin, and pieces of the specimen are sliced therefrom, in the direction of fiber axis, using a microtome. The specimen is set in position in the TEM, and the optical system of electron microscope is adjusted to the position where image observation of (002) planes in dark field can be made. Alternatively, a fiber specimen may be ground in an agate mortar and mounted on the grid of electron microscope.

Usually, the image of a transmission electron microscope is formed only by the electron beam which has passed through a specimen, after insertion of an objective stop on the optical axis. This image is called a bright field image. The parts by which diffraction has caused to occur, look dark on the image. In contrast, an image formed by electron beams which have subjected to diffraction by shifting the objective stop is called a dark field image, and the parts which cause diffraction to occur are observed brightly in the dark background, whereby it is possible to know the shape of a crystal plane (thickness, length and fold radius).

Figure 8:
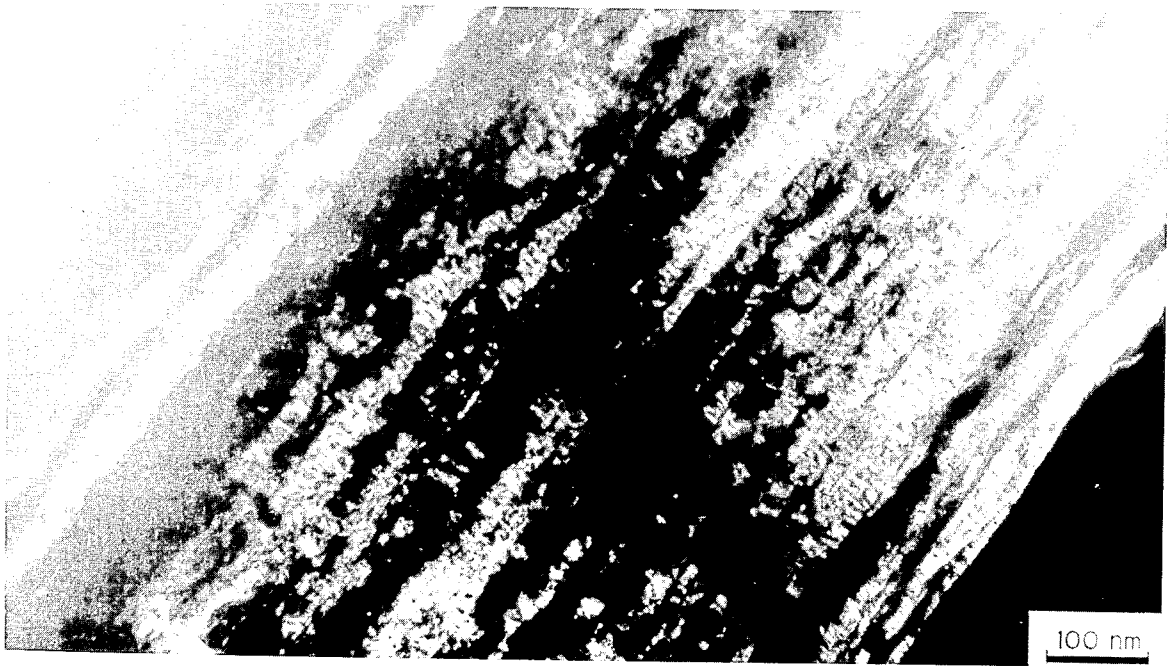
FIG. 8 is a dark field image of the (002) planes of the carbon fibers of the present invention.

When fold structure is formed, white bright domains are observed, as shown in FIG. 8. The more successive and the narrower the space of observed white bright domain, the greater the frequency (i.e. density of occurrence) of fold. Fold diameter can be obtained by measuring the distance of the above-mentioned space. This phenomenon is discussed by A. Oberlin et al, (*Fiber Science and Technology* 20, 177–198, 1984), with regard to high modulus of elasticity carbon fiber produced from polyacrylonitrile (PAN) fibers, but this structure is not known with regard to carbon fibers derived from mesophase pitch.

Although the carbon fibers made from PAN fibers show a fold structure in the cross-section, it is difficult to graphitize PAN itself because it is inherently non-graphitizable. The crystal arrangement in the direction of fiber axis is poor, and cannot substantially impart a high modulus of elasticity to the products.

According to the present invention, when mesophase pitch, as a raw material, is subjected to spinning by using a spinning nozzle having a greater outlet part cross-sectional area than a narrowest cross-sectional area in the extrusion holes, and the spun yarns then are subjected to thermosetting and carbonization processing as in the conventional process, there are obtained carbon fibers derived from mesophase pitch having folded sheets of carbon layers consisting of a basic structure of hexagonal carbon network planes with a short fold radius of 15 to 200 A in cross-section, as observed by the dark field image of (002) planes.

Figure 9:
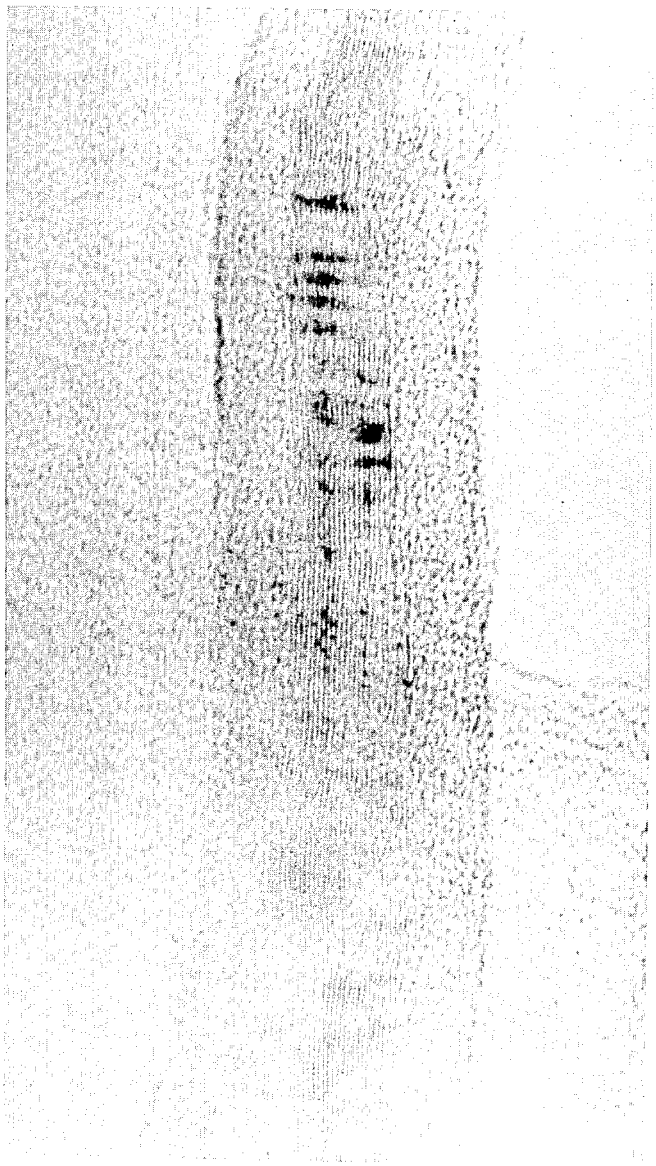
FIG. 9 is a lattice-fringe image of the (002) planes of the carbon fibers of the present invention.

On account of this fold structure, shrinkage between the planes of carbon layers a used by internal strain does not occur even when the carbon fibers are heated and carbonized at a temperature of 2000°–3000° C. Namely, it can impart effectiveness of greatly controlling the inherent graphitizing property. Further, since the shrinkage in the fiber cross-section occurs simultaneously not only in the direction of circumference but also in the direction of diameter, the fibers take a structure which prevents crack formation therein. Specifically, the shrinkage in fiber cross-section occurs not only in the circumferential direction, but also at random. The shrinkage between carbon layer plane is also much smaller than that of carbon fiber derived from mesophase pitch having the usual characteristic features of a three-dimensional arrangement unique to polycrystalline graphite. This is due to the prevention of shrinkage in an interlayer spacing ($d_{002}$) by the internal strain between folded planes. On the other hand, in the direction of the fiber axis, the arrangement of the network plane maintains a structure characteristic of a long arrangement common to mesophase pitch as shown in attached drawings of FIG. 9. Thus, a structure having increased resistance to propagation of microcracks within the fibers is provided. The carbon fibers have high strength while maintaining a high modulus of elasticity since the original high orientation of hexagonal planes in the direction of the fiber axis characteristic of spun mesophase pitch is retained.

By greatly suppressing graphitizing property, it has been made feasible to form new mesophase derived carbon fibers having characteristics of high strength, and high elongation which is extremely significant in this application and cannot be found in conventional mesophase derived carbon fibers.

Even when the carbon fibers are heated at a temperature of 2000° C.–3000° C. to effect carbonization, the arrangement of the network plane in the direction of fiber axis is sufficiently long and the shrinkage in the cross-section of fibers occurs not in a fixed direction but at random due to the fold structure of the cross-section as mentioned above. Further, the shrinkage between planes of carbon layers is prevented by the internal strain of folded surface of layers. The degree of shrinkage is smaller than that of mesophase pitch carbon fibers having the characteristic three dimensional arrangement of polycrystalline graphite. On this account, in the electron diffraction pattern and x-ray diffraction patter; the (10) band is not resolved into two different (100) and (101) lines (see FIG. 10 ). Further, when inter-layer spacing ($d_{002}$) of (002) band is determined from each of the above-mentioned patterns, it is no smaller than 3.38 A, and electric resistance is greater than $250\times10^{-6}$ ohm-cm at room temperature. The magnetic resistivity, which is measured by applying a magnetic field in the direction right-angles to the fiber axis, always has a negative value thus, the feature of turbostatic structure of carbon which suppresses the development of the three-dimensional arrangement unique to conventional mesophase derived carbon fibers is confirmed in the carbon fibers of the present invention.

Magnetic resistivity can be expressed by the following formula $$\text{Magnetic resistivity (\%)} = \frac{\rho_H - \rho_O}{\rho_o} \times 100$$

wherein $\rho$ (ohm-cm) is an electric resistance of carbon fibers in cases where an outside magnetic field is applied and $P_O$ (ohm-cm) is an electric resistance of carbon fibers in case where no outside magnetic field is applied.

According to M. Endo et al, [*J. Phys. D.: Appl. Phys.*, 15, 353 (1982)], positive magnetic resistance effect appears when a graphite structure is formed, i.e., when the fraction possessing three-dimensional arrangement is greater than the fraction forming a turbostatic structure. On the other hand, negative magnetic resistance effect appears when the fraction having a turbostatic structure is greater ,than the fraction having a graphite structure. Further, the greater the turbostatic fraction, the greater the negative magnetic resistivity.

In the carbon fibers of the present invention the magnetic resistivity always has a negative values, even when the outside magnetic field is varied throughout the measurement temperature range of 4.2° K. to 300° K. It can be confirmed from this magnetic resistivity that the development of a three-dimensional arrangement unique to polycrystalline graphite is greatly suppressed and the characteristics of turbostatic structure of carbon is maintained.

Following examples are offered by way of illustrating and not by way of limitation.

EXAMPLE 1

Figure 3:
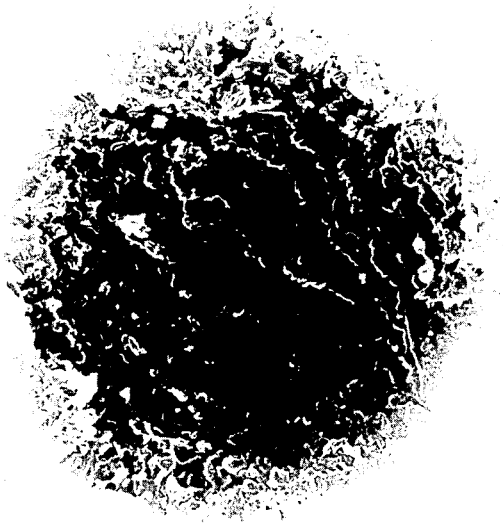
FIG. 3 is a cross-section of carbon fibers having a random and partly onion shape prepared according to the method of the present invention (observed using an SEM)

Distillate fractions of petroleum pitch of residual carbonaceous material produced as a by-product of catalytic cracking of vacuum gas oil (F.C.C.) (having a initial boiling point of 404° C. and a final boiling point of 560° C. or lower) was subjected to heat treatment at a temperature of 400° C. for 2 hours in a non-oxidizing atmosphere of a recovered lower hydrocarbon gas, then to aging of the mesophase at a temperature of 320° C. for 10 hours, causing the very fine inorganic solid matter of the catalyst for thermal cracking, and the large-molecular weight organic materials present in the petroleum-origin pitch, in the form of a mixture, to be included in the mesophase. The pitch was purified by separating the impurity containing part, and heated to 400° C. for 6 hours to produce a pitch containing 45.2% mesophase. The pitch was aged, and 100% mesophase was obtained by using the difference in viscosity (mesophase has a viscosity of 108 poise, and non-mesophase 10 poise at a temperature of 308° C.). By using the 100% mesophase thus obtained, as a raw material, and a spinning nozzle shown in FIG. 1, spinning was carried out at a spinning temperature of 303° C. and a take-up velocity of 280 m/min. The resultant raw filament yarns were subject to thermosetting at 300° C. and then carbonization at 2800° C. to produce high strength and high modulus filament yarns of carbon fibers having a random shape and partly onion shape arrangement in the cross-section thereof, as shown in FIG. 3, a strength of 332 Kgf/mm$^2$, a modulus of elasticity of $74.4\times10^3$ Kgf/mm$^2$, and an elongation of 0.44% and having no cracks at all.

EXAMPLE 2

Figure 7:
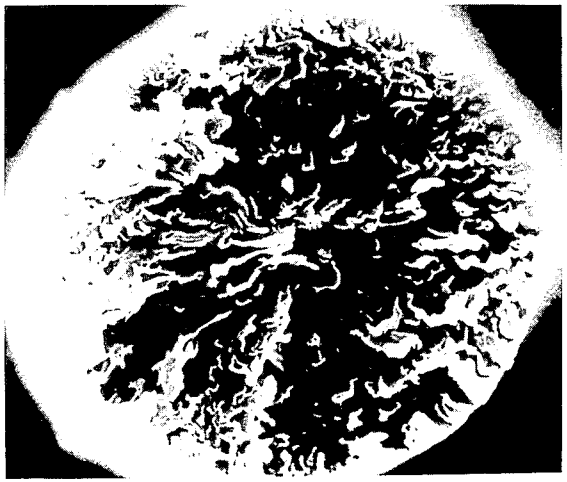
FIG. 7 is a photograph of the cross-section of the filament yarns of carbon fibers of Example 2 made by using the nozzle according to the present invention and observed using SEM.

By using the 100% mesophase used in Example 1, as a raw material, and the nozzle shown in FIG. 5 (having a diameter at the inlet hemisphere part of the nozzle of 2.5 mm, a diameter at the inlet nozzle thin tube part of nozzle of 0.15 mm, a length of the narrowest thin tube part of nozzle of 0.3 mm and a diameter at the outlet hemisphere part of 0.3 mm), melt spinning was carried out at a spinning temperature of 290° C. and a spinning velocity of 500 m/min. The resulting filament yarn was subjected to thermosetting at a temperature of 300° C. and to carbonization at a temperature of 2800° C. to obtain carbon fibers. When the cross-section of these fibers was observed using an SEM, it was found that it is close to a radial shape, as shown in FIG. 7. The strength, modulus of elasticity and elongation were found to be 340 Kgf/mm$^2$, $75\times10^3$ Kgf/mm$^2$ and 0.45%, respectively and containing no crack.

Figure 10:
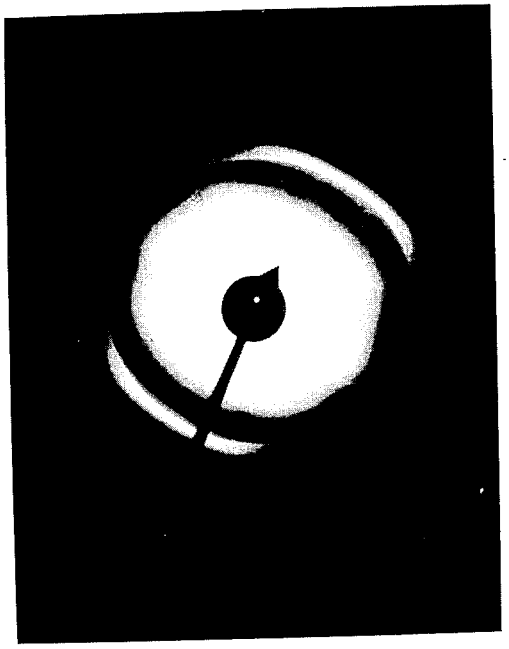
FIG. 10 is an election diffraction pattern of the carbon fibers of the present invention.
Figure 11:
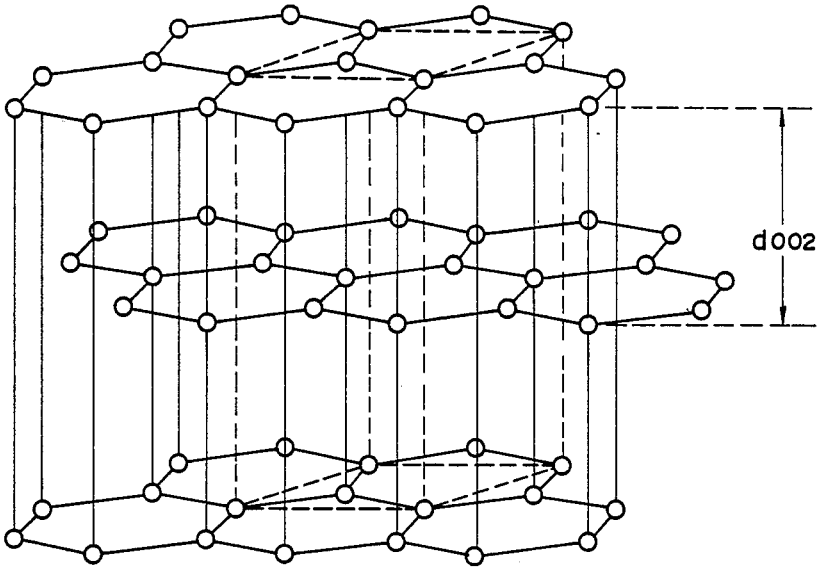
FIG. 11 is an illustration of three dimensional structure of polycrystalline graphite.

Thin pieces of carbon fibers produced according to the same method, were prepared using a microtome and the dark field image of (002) plane was observed using a transmission electron microscope, whereby the distance of brightly shining region as shown in FIG. 8 were 30~100 Å and the cross section of fibers formed fold structure of wrinkled layer with a short cycle. When an electron diffraction pattern was observed according to the same procedure, the (10) band was not resolved into two different lines of (100) and (101), as shown in FIG. 10. When structural parameters were measured from the result of x-ray diffraction of the carbon fibers prepared according to the same method, it was found that the layer size (La), arranged in the direction of fiber axis, was 550 A, height of layer stack ($Lc_{002}$) was 350 A and layer spacing of band (002) was 3.39 A. Electric resistance of the carbon fibers was $330\times10^{-6}$ ohm-cm at room temperature and magnetic resistivity was −0.07% at a temperature of 77° K. and under a magnetic field of 3 KG, and −0.3% under a magnetic field of 8 KG.

COMPARATIVE EXAMPLE 1

The carbon fibers produced from the 100% mesophase made according to the method of Example 1 by using a spinning nozzle having a non-enlarged outlet of 0.3 mm inside diameter in its circular cross-section and the spinning condition, thermosetting condition, carbonization condition of Example 1, showed a radial shape in the arrangement of carbon in the cross-section of the carbon fibers as shown in FIG. 4 and created cracks of about 90° in angle. The fibers had no value as articles of commerce.

EXAMPLE 3

A distillate fraction higher than 404° C., as initial distilling point, of residue of thermal catalytic cracking of vacuum gas oil was subjected to heat treatment at 420° C. for 2 hours while sending there methane gas and further to heating at 320° C. for 16 hours to cause mesophase to grow by aging and a part consisting mostly of mesophase was separated. The mesophase content of this mesophase pitch was 91% according to the measurement under a reflecting type polarizing microscope and the softening point (as measured by a Koka type flow tester) was 215° C.

Using this mesophase pitch as a raw material, and using spinning nozzles shown in FIG. 1 (having 100 extrusion holes i.e., passage for spinning dope which have a diameter at the inlet part of spining dope of 2.5 mm, a diameter at the narrowest thin tube part of 0.15 mm, the length of the narrowest thin tube part of 0.3 mm, an angle of cone expanding toward the outlet part of 90°, a diameter at the outlet part of 0.3 mm) spinning was carried out at a spinning temperature of 285° C., and a spinning velocity of 180 m/min. Resultant filament yarns of pitch fibers were subjected to thermosetting at 300° C. and then to carbonization at 2700° C. to produce products. When the cross-section of these filaments of carbon fibers was observed under a scanning electron microscope (SEM), it was found that the structure of the cross-section thereof was of radial pattern and there was no crack formed. Further, resultant filaments of carbon fibers had a tensile strength of 300 $Kgf/mm^2$, a modulus of elasticity of $70\times10^3$ $Kgf/mm^2$ and an elongation of 0.43%.

Thin specimens of carbon fibers were prepared by the same process, and sliced by a microtome. Images of (002) planes were observed in dark field with a transmission electron microscope. Fiber cross-sections were folded forming wrinkled layer with a short cycle. According to electron diffraction pattern prepared by the same procedure, the broad (10) line was not resolved into distinct (100) and (101) lines. In X-ray diffraction determination of structural parameters from carbon fibers prepared by the same process, they had layer size La of 500 A, i.e., sufficiently long in the direction of fiber axis. Also, they had a height of layer stack of 300 A and layer spacing $d_{(002)}$ of 3.40 A. Electric resistance of carbon fibers prepared by the same process was $350\times10^{-6}$ ohm-cm at room temperature.

EXAMPLE 4

Using the mesophase pitch used as in Example 3 as a raw material, and using spinning nozzles having 100 extrusion holes in which the diameter of spinning dope introducing part is 2.5 mm, the diameter of the thinnest tube part is 0.1 mm, the length of the thinnest tube part is 0.1 mm, and the diameter at the outlet part is 0.25 mm (expanding by forming a hemisphere), filament yarns of carbon fibers were produced by spinning at a spinning temperature of 300° C. and the spinning velocity of 210 m/min. followed by other processing in the same manner as in Example 1. The representative cross-sectional structure of resultant carbon fibers was mostly of random and partly onion-like pattern. There was found no crack at all.

COMPARATIVE EXAMPLE 2

Using the mesophase pitch used in Example 3 as a raw material and using spinning nozzles having extrusion holes in which thin tube parts of the extrusion holes are of a straight tube having a diameter of 0.3 mm in cross-section and 0.3 mm in length and also having a diameter of 0.3 mm at the outlet part, filament yarns of carbon fibers were produced under the same conditions for spinning, thermosetting and carbonization as in Example 3. When the cross-section of the resultant filaments of carbon fibers was observed under a scanning type electron microscope, the structure of the cross-section of the filaments yarn of carbon fibers was of radial shape and there was formed a crack having an angle of about 90°. Resultant filaments of carbon fibers had a tensile strength of 157 $Kgf/mm^2$ a modulus of elasticity of $38\times10^3$ $Kgf/mm^2$ an elongation of 0.41%.

We claim:

1. High strength, high modulus carbon fibers derived from mesophase pitch consisting essentially of a plurality of sheets consisting essentially of long arrangements of planes of hexagonal carbon networks, said sheets being highly oriented in the direction of the fiber axis, and having, in cross-sections, a wrinkled layer structure with a radius of curvature in the range of 15–200 Å, said sheets being characterized in that the (10) band is present in the electron ray and x-ray diffraction patterns, but is not resolved into separate (100) and (101) lines even after being heated and carbonized at a temperature up to 3000° C., having an inter-layer spacing $d_{002}$ greater than 3.38 Å, and electric resistance greater than $250\times10^{-6}$ ohm-cm at room temperature, and a magnetic resistivity which is always negative when measured between 4.2° K. and 300° K. in a magnetic field between 0 KG and 8 KG.

2. High strength, high modulus carbon fibers according to claim 1, produced by the process of subjecting petroleum pitch to heat treatment in a non-oxidizing atmosphere to form a mesophase component in said pitch, aging said pitch at a lower temperature until said mesophase component has coalesced, separating said mesophase component, melt spinning said mesophase component at a temperature of 250° C. to 350° C. using a spinning nozzle having a greater cross-sectional area at the outlet thereof than at the narrowest inside portion thereof, and thermosetting and carbonizing the spun fiber.

3. High strength, high modulus carbon fibers according to claim 1 wherein said radius of curvature is between 20 and 60 angstroms.

4. High strength, high modulus carbon fibers according to claim 2, wherein said separated mesophase component is between 70 and 100% mesophase pitch.

5. High strength, high modulus carbon fibers according to claim 2 wherein said separated mesophase component is substantially 100% mesophase pitch.

6. High strength, high modulus carbon fibers according to claim 1, wherein said layer spacing $d_{002}$ is greater than or equal to 3.39 angstroms.

7. High strength, high modulus carbon fibers according to claim 1, wherein said fiber having a Young's modulus of greater than $60\times10^3$ Kgf/mm, a tensile strength greater than 280 Kgf/mm and being substantially free of longitudinal cracks in the surface.

* * * * *